US006696118B2

(12) United States Patent
Asaoka et al.

(10) Patent No.: US 6,696,118 B2
(45) Date of Patent: Feb. 24, 2004

(54) RECORDING MEDIUM AND IMAGE FORMING METHOD UTILIZING THE SAME

(75) Inventors: Masanobu Asaoka, Kanagawa (JP); Kenji Onuma, Tokyo (JP); Katsutoshi Misuda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/960,417

(22) Filed: Sep. 24, 2001

(65) Prior Publication Data

US 2002/0061387 A1 May 23, 2002

(30) Foreign Application Priority Data

Sep. 27, 2000 (JP) ..... 2000-294633

(51) Int. Cl.[7] ..... B41M 5/40
(52) U.S. Cl. ..... 428/32.37; 428/32.24; 428/32.25
(58) Field of Search ..... 428/212, 195, 428/304.4, 329, 32.24, 32.25, 32.37

(56) References Cited

U.S. PATENT DOCUMENTS

| | | | | | |
|---|---|---|---|---|---|
| 4,202,870 | A | | 5/1980 | Weber et al. | 423/630 |
| 4,242,271 | A | | 12/1980 | Weber et al. | 260/448 AD |
| 4,391,960 | A | | 7/1983 | Kleine et al. | 526/74 |
| 4,879,166 | A | | 11/1989 | Misuda et al. | 428/212 |
| 5,041,328 | A | * | 8/1991 | Akiya et al. | 428/212 |
| 5,081,470 | A | * | 1/1992 | Kurabayashi et al. | 346/1.1 |
| 5,104,730 | A | | 4/1992 | Misuda et al. | 428/304.4 |
| 5,171,626 | A | | 12/1992 | Nagamine et al. | 428/212 |
| 5,264,275 | A | | 11/1993 | Misuda et al. | 428/304.4 |
| 5,266,383 | A | | 11/1993 | Sakaki et al. | 428/195 |
| 5,561,454 | A | * | 10/1996 | Kurabayashi et al. | 347/105 |
| 5,576,088 | A | * | 11/1996 | Ogawa et al. | 428/327 |
| 5,720,806 | A | * | 2/1998 | Fujii et al. | 106/483 |
| 5,750,200 | A | * | 5/1998 | Ogawa et al. | 427/361 |
| 5,912,071 | A | | 6/1999 | Takeshita et al. | 428/304.4 |
| 6,000,794 | A | * | 12/1999 | Kondo et al. | 374/105 |
| 6,114,020 | A | * | 9/2000 | Misuda et al. | 428/212 |
| 6,200,670 | B1 | | 3/2001 | Hosoi et al. | 428/195 |
| 6,203,899 | B1 | | 3/2001 | Hirose et al. | 428/341 |
| 6,465,086 | B1 | * | 10/2002 | Kitamura et al. | 428/212 |

FOREIGN PATENT DOCUMENTS

| | | | | |
|---|---|---|---|---|
| EP | 0 331 125 | A2 | 9/1989 | |
| EP | 0 524 626 | A1 | 1/1993 | |
| EP | 0 858 907 | A1 | 8/1998 | |
| JP | 52-9074 | A | 1/1977 | |
| JP | 55-51583 | A | 4/1980 | |
| JP | 56-157 | A | 1/1981 | |
| JP | 57-44605 | A | 3/1982 | |
| JP | 62-244689 | * | 10/1987 | B41M/5/00 |
| JP | 2-43083 | A | 2/1990 | |
| JP | 2-276670 | A | 11/1990 | |
| JP | 3-284978 | A | 12/1991 | |
| JP | 4-37576 | A | 2/1992 | |
| JP | 4-267180 | A | 9/1992 | |
| JP | 5-32037 | A | 2/1993 | |
| JP | 6-79967 | | 3/1994 | |
| JP | 6-199034 | A | 7/1994 | |
| JP | 9-66660 | A | 3/1997 | |
| JP | 9-66663 | A | 3/1997 | |
| JP | 10-94754 | | 4/1998 | |
| JP | 11-1060 | A | 1/1999 | |
| JP | 11-1060 | | 1/1999 | |
| JP | 2000-127613 | A | 5/2000 | |
| JP | 2001-198265 | | 7/2001 | |

OTHER PUBLICATIONS

Josef Roček, et al., "Effect of Precipitation and Aging on Porous Structure of Aluminium Hydroxide, I. Statistical Treatment of Experimental Data", Collection of Czechoslovak Chemical Communications, vol. 56, No. 4, pp. 1253–1262, (Apr., 1991).

Josef Roček, et al., "Porous structure of aluminium hydroxide and its content of pseudoboehmite", Applied Catalysis, vol. 74, pp. 29–36, (Jun. 27, 1991).

* cited by examiner

*Primary Examiner*—Cynthia H. Kelly
*Assistant Examiner*—B. Shewareged
(74) *Attorney, Agent, or Firm*—Fitzpatrick, Cella, Harper & Scinto

(57) ABSTRACT

An ink-jet recording medium comprising a base material and an ink-receiving layer provided thereon. The ink-receiving layer comprises an upper layer containing an aluminum-based pigment and a lower layer containing an aluminum-based pigment having a BET specific surface area larger than that of the aluminum-based pigment contained in the upper layer.

17 Claims, No Drawings

RECORDING MEDIUM AND IMAGE FORMING METHOD UTILIZING THE SAME

BACKGROUND OF THE INVENTION

1. Field of the Invention

The present invention relates to a recording medium suitable for forming a print having texture and image quality of a silver halide photograph by a method of applying droplets of recording liquid such as ink, particularly by an ink-jet recording method, and an image forming method utilizing such recording medium.

2. Related Background Art

The ink-jet recording method is to record an image or a character by causing a micro droplet of liquid (recording liquid) such as ink to fly by various working principles and applying such micro droplet to a recording medium such as paper it has advantages of large flexibility in the recording pattern and not requiring a development process, and is rapidly spreading not only to the stand-alone printer but also the output unit in information equipment such as copying apparatus, word processors, facsimile apparatus, plotters etc. Also various imaging equipment of high performance such as digital cameras, digital video cameras, scanners etc. are recently commercialized inexpensively and a printer utilizing the ink-jet recording method is becoming employed advantageously for the output of image information obtained by such imaging equipment, in combination with the popularization of the personal computer. Based on such background, it is being desired to output an image comparable to that of the silver halide photograph or the multicolor press printing, in a simpler manner by the ink-jet recording method.

In order to meet such requirement, there have been achieved improvements in the structure of the printer itself and in the recording method toward a higher recording speed, a higher definition and higher image quality in full-color recording, and there are being actively investigated improvements on the structure and characteristics of the recording medium.

For the recording medium to be employed for example in the ink-jet recording, there have already been proposed the media of various configurations. For example, the Japanese Patent Application Laid-open No. 52-9074 discloses a recording medium provided, as an ink-receiving layer, with a layer having a void and consisting principally of a silica pigment of a large specific surface area in order to increase the ink absorbing rate, and the Japanese Patent Application Laid-open No. 63-22997 discloses a recording medium in which the void of the pigment layer constituting the ink-receiving layer is regulated. Also the Japanese Patent Applications Laid-open Nos. 55-51583 and 56-157 teach mixing of powdered amorphous silica in order to improve the ink absorptivity of the ink-receiving layer and to obtain a high print density and print dot without bleeding.

For the component of the ink receiving portion in the recording medium, alumina hydrate is attracting attention in recent years, because alumina hydrate provides advantages such as a high coloring ability and an image of high gloss owing to the fact that the alumina hydrate has a positive charge to improve the fixability of the dyes in the ink.

With respect to the recording medium utilizing such alumina hydrate, for example U.S. Pat. Nos. 4,879,166 and 5,104,730 and the Japanese Patent Applications Laid-open Nos. 2-276670, 4-37576 and 5-32037 disclose a recording medium having, as the ink-receiving layer, a layer containing alumina hydrate of pseudo-boehmite structure, while the Japanese Patent Application Laid-open No. 10-94754 discloses a recording medium containing particles of alumina hydrate in the ink-receiving layer.

Also the Japanese Patent Application Laid-open No. 11-1060 discloses a recording medium having a porous layer containing barium sulfate and a layer containing non-oriented alumina hydrate in succession in this order as the ink-receiving layer on a base material in order to increase the ink absorption rate thereby preventing the beading phenomenon and achieving excellent print quality. Also for achieving high ink absorptivity and high gloss at the same time, the Japanese Patent Application Laid-open No. 6-79967 discloses a recording medium including a layer containing alumina hydrate by cast coating. Also the Japanese Patent No. 2686670 discloses to form a two-layered ink-receiving layer consisting of an upper layer and a lower layer wherein the upper layer is principally composed of aluminum oxide of a large specific surface area and the lower layer is principally composed of a pigment of a small specific surface area, thereby obtaining a high image density.

In these recording media, there are being proposed various methods in order to further increase the image density and the color saturation. For example there is proposed a method of adding a cationic agent to retain the dye in the vicinity of the surface or a method of increasing the ink shot-in quantity to the recording medium thereby raising the dye density. However, in the method of increasing the ink shot-in quantity, there is required an even larger ink absorptivity in the ink receiving portion of the recording medium. For this purpose there is being tried to employ a pigment of a large pore volume thereby forming a structure having larger voids for absorbing and retaining the ink in the ink-receiving layer or to employ an ink-absorbing high molecular material for constituting the ink-receiving layer, but the formed dot may become turbid for example by random light reflection whereby the desired image density or gloss may not be attained. Also in order to increase the ink absorptivity, it is often necessary to increase the coating thickness of the ink-receiving layer, and there has to be adopted a costly method both in the materials and the manufacturing steps.

Also the method of adding the cationic agent is certainly capable of retaining the dye in the vicinity of the surface of the recording medium thereby increasing the image density, but the fastness of the image to light or ozone may not be sufficient depending on the composition of the ink.

SUMMARY OF THE INVENTION

The object of the present invention is to provide a recording medium having excellent surface gloss, an extremely high print image density and reduced deterioration of the print image with age by light or by ozone at a low cost, and to minimize the time required for color stabilization after printing.

The above-mentioned object can be attained, according to the present invention, by a recording medium provided with a base material and an ink-receiving layer provided thereon, wherein the ink-receiving layer is composed of an upper layer containing an aluminum-based pigment and a lower layer containing an aluminum-based pigment having a BET specific surface area larger than that of the aluminum-based pigment in the upper layer.

Also according to the present invention, there is provided an image forming method which is featured by forming an image by applying a recording liquid according to the recording information to a surface formed by the ink-receiving layer of the recording medium of the above-described configuration.

The present invention can provide a recording medium having excellent surface gloss, an extremely high print image density and reduced deterioration of the print image with age by light or by ozone at a low cost, and to minimize the time required for color stabilization after printing.

The color stabilization mentioned in the present invention indicates the following phenomenon. In case of printing on a recording medium having a receiving layer principally composed of micro particles as in the configuration of the present invention, there is generated, immediately after the printing operation, a phenomenon that the receiving layer becomes turbid by the absorption of solvent therein whereby the developed color also becomes turbid. Such turbidity in color is resolved by the evaporation of the solvent and by a shift from the receiving layer to a lower layer, whereby the color density becomes stable in time. Such phenomenon is called color stabilization.

Also since an extremely high image density can be obtained in the image formation on the recording medium, there can be obtained an image having texture and image quality comparable to those of the silver halide photograph. Thus, by selecting an input system such as a digital camera and employing the ink-jet recording method for image output, there can be provided a print with a high-definition and high-quality image comparable to or exceeding, in texture and image quality, the silver halide photograph, in a process simpler and faster than the process for the silver halide photography.

The above-described effects of the present invention may be ascribable to the following functions. For example the Japanese Patent No. 2686670 discloses an ink-receiving layer consisting of an upper layer principally composed of aluminum oxide and a lower layer principally composed of aluminum oxide having a specific surface area smaller than that of the aluminum oxide in the upper layer. Such configuration of the ink-receiving layer is based on a concept of capturing the ink in the surface side (upper layer) of the ink-receiving layer by positioning the aluminum oxide particles of a larger specific surface area in the upper layer, thereby increasing the image density. However such configuration of the ink-receiving layer does not take into consideration the object of reducing the time required for stabilization of the color printed in the ink-receiving layer, and may require a long time for the color stabilization depending on the configuration of the ink-receiving layer. Such drawback is also found in a recording medium having a single-layered ink-receiving layer employing alumina hydrate or aluminum oxide of a BET specific surface area similar to that in alumina hydrate or aluminum oxide employed in the upper layer of the present invention.

On the other hand, the present invention is based on a new finding that, reached in investigating a configuration capable of reducing the time required for the stabilization of the color printed in the ink-receiving layer, a layer configuration in which the lower layer contains aluminum pigment of a BET specific surface area larger than that of aluminum pigment contained in the upper layer can reduce the time required for stabilization of the printed color while securing the image density. In the present invention, the pigment of a larger BET specific surface area is employed in the lower layer to retain the dye in the upper layer thereby promptly absorbing the solvent contained in the ink and promptly eliminating the color turbidity caused by the solvent.

DETAILED DESCRIPTION OF THE PREFERRED EMBODIMENTS

The recording medium of the present invention is composed of a base material and an ink-receiving layer provided thereon, and the surface at the side of the ink-receiving layer constitutes the image recording surface. The ink-receiving layer is composed of an upper layer principally composed of an alumina-based pigment and a lower layer containing, as the principal component, an alumina-based pigment having a BET specific surface area larger than that of the alumina-based pigment in the upper layer, and is preferably formed as a porous layer as a whole. The recording liquid (ink) supplied from the recording apparatus is absorbed in the ink-receiving layer.

The base material for forming the ink-receiving layer can be a fibrous base material principally composed of wood pulp and a filler, such as suitably sized paper or non-sized paper. For obtaining texture similar to that of the silver halide photograph, the fibrous base material preferably has a basis weight of 120 g/m$^2$ or higher, more preferably within a range of 150 to 180 g/m$^2$, and a Stockigt sizing degree of 100 seconds or larger, more preferably 200 seconds or larger. Such fibrous base material can provide a recording medium having high-quality texture even at A4- or A3-size.

In order to obtain a high image density in the present invention, the base material is preferably provided with a surface layer composed for example of an inorganic pigment and a binder. Such inorganic pigment is preferably composed for example of barium sulfate or the like, and there is more preferred a dense base material of low gas permeability having a surface layer containing barium sulfate.

In case of employing a surface layer containing barium sulfate, such surface layer can be formed on the surface of the base material by utilizing barium sulfate and a binder as principal components. Barium sulfate should preferably have an impurity content as low as possible, in order to improve the whiteness and light fastness of the surface of the recording medium. Besides it desirably has an effective average particle diameter in order to improve the smoothness, gloss and solvent absorbability of the surface of the layer. The average particle diameter of barium sulfate is preferably within a range of 0.4–1.0 $\mu$m, more preferably 0.4–0.8 $\mu$m. The average particle diameter specified within such range can achieve better whiteness, gloss and solvent absorbability in the recording medium. If necessary, there may be applied a smoothing process such as super calendering.

The surface layer containing barium sulfate has a high whiteness and a high refractive index thereby having a very high reflectance. Therefore, there can be obtained a recording medium satisfactory in whiteness and gloss. Also the presence of the surface layer containing barium sulfate improves the surface smoothness of the fibrous base material. Furthermore, the use of a base material obtained by forming a layer containing barium sulfate on a dense fibrous base material enables image formation while preventing slippage for example caused by the swelling of the base material in an ink-absorbing portion in the printing operation.

The binder for barium sulfate can be composed of any polymer having binding ability within a range not detrimentally affecting the effect of the present invention. Examples of such binder include polyvinyl alcohol, vinyl acetate, oxidized starch, etherized starch, casein, gelatin, soybean protein, and synthetic polymer such as styrene-butadiene latex, polyvinyl acetate, polyacrylate esters, polyesters, or polyurethanes. These binders may be employed singly or in combinations of plurality. The composition ratio of barium sulfate and binder can be selected, in terms of ratio, preferably within a range of 10:0.5–10:10, more preferably 10:0.7–10:10 and in particular within a range of 10:1–10:5.

Among these binders, gelatin is particularly preferred because barium sulfate and gelatin have similar refractive indexes to effectively reduce the reflection at the interface thereby increase the gloss of the recording medium by 20°. There may be employed any gelatin regardless of the preparation process therefor, such as acid-processed gelatin or alkali-processed gelatin. In case where gelatin is combined with barium sulfate to form so-called baryta layer, gelatin is preferably employed in 6 to 12 parts by weight with respect to 100 parts by weight of barium sulfate. In such case, there may be employed a crosslinking agent for gelatin such as chromium sulfate, chromium alum, formalin or triazine, if necessary. The composition ratio of the crosslinking agent is preferably 0.2–4 parts by weight with respect to 100 parts by weight of gelatin. The preferred crosslinking agent is chromium alum in consideration of ease of handling.

The surface layer containing barium sulfate can be formed by coating and drying coating liquid, obtained by dispersing barium sulfate, together with a binder if necessary, in a suitable solvent such as water, on the base material.

The coating amount of the surface layer containing barium sulfate is preferably within a range of 10–40 g/m$^2$ in order to obtain sufficient absorbability for the solvent component of the ink and necessary smoothness. The coating and drying methods In forming the surface layer containing barium sulfate are not particularly limited but a surface smoothing process such as supercalendering is preferably conducted as a finishing process.

It is also possible to prevent dissolution of the constituents of the layer containing barium sulfate, if necessary, by a heating process, an acetallation process by mixing a thermosetting resin in the surface layer, or a chemical reaction by a film hardening agent. In forming the ink-receiving layer on the surface layer containing barium sulfate, the dissolution of the constituents thereof may cause turbidity in the coating liquid for the ink-receiving layer, thereby resulting in a loss in the transparency of the ink-receiving layer or affecting the drying characteristics in the layer forming process, tending to generate defects such as deteriorated surface properties or cracks. The above-mentioned process is preferred in order to prevent such drawbacks.

The coating liquid may be added further with a dispersant, a viscosifier, a pH adjusting agent, a lubricant, a fluidity modifier, a surfactant, an antifoaming agent, a water repellant, a releasing agent, a fluorescent whitening agent, an ultraviolet absorber, an antioxidant etc. within a range not affecting the effects of the present invention.

In case of employing a base material having a surface layer containing barium sulfate, the whiteness and smoothness of the recording medium are mostly determined by such surface layer. Consequently, the whiteness and Bekk smoothness of the surface layer containing barium sulfate are preferably so set that the whiteness and the Bekk smoothness of the ink-receiving layer of the finally obtained recording medium are respectively not less than 87% and not less than 400 seconds. The Bekk smoothness at the surface of the recording medium is preferably set not exceeding 600 seconds, more preferably not exceeding 500 seconds, since an excessively high smoothness may deteriorate the absorbability for the solvent component of the recording liquid.

Also the gas permeability of the base material is preferably low. In case of a base material with a high gas permeability, the fibers of the base material have a low density, and such base material generates waving by wetting with the absorbed ink in the printing operation on such base material, thereby being incapable of providing a texture comparable to that of the silver halide photograph.

On the other hand, the alumina-based pigment to be employed for forming the ink-receiving layer on the base material is required to meet the desirable characteristics such as:

1) fast ink absorption without unnecessary bleeding;

2) high print density and color developing ability; and 3) high weather resistance;

and to form an ink-receiving layer with the predetermined gloss as explained in the foregoing.

A preferred example of such alumina-based pigment can be represented by the following general formula:

$$Al_2O_{3-n}(OH)_{2n}\cdot mH_2O$$

wherein n stands for 0, 1, 2 or 3; m stands for an integer within a range of 0–10, preferably 0–5, and m and n do not become 0 at the same time. In most cases, $mH_2O$ represents releasable water phase not contributing to the formation of crystal lattice, so that m may be an integer or a non-integral value. Also the value m may becomes 0 when such material is heated. In general, alumina hydrate can be produced by already known methods such as hydrolysis of aluminum alkoxide or sodium aluminate as described in the U.S. Pat. Nos. 4,242,271 and 4,202,870 or neutralization by adding aqueous solution of aluminum sulfate or aluminum chloride to aqueous solution of sodium aluminate as described in the Japanese Patent Application Laid-open No. 57-44605.

Also Rocek et al. (collect czech Chem Commun, 56, 1253-1262, 1991) reports that the porous structure of alumina hydrate is affected by precipitation temperature, solution pH, maturing time and surfactant. Also in alumina hydrate, pseudo boehmite is known to have fibrous form and non-fibrous form as reported by Rocek J. et al. (Applied Catalysis, 74, 29–36, 1991).

Furthermore, alumina hydrate preferably meets the aforementioned required characteristics such as transparency, gloss and fixing ability for the color agent such as a dye in the recording liquid and shows satisfactory coating property without generation of defects such as a crack at the formation of the ink-receiving layer. In consideration of the foregoing, alumina hydrate such as prepared by the aforementioned known methods or selected from commercial products such as Disperal HP13 (trade name; manufactured by Condea Inc.) can be employed as the alumina-based pigment constituting the ink-receiving layer.

Another example of alumina-based pigment is aluminum oxide, which is manufactured by so-called Bayer's process, namely by sintering aluminum hydroxide obtained by thermally processing naturally produced bauxite with sodium hydroxide. Also there can be employed aluminum oxide produced by baking aluminum hydroxide obtained by processing aluminum metal pellets with spark discharge in water by decomposing an inorganic aluminum salt (alum etc.).

The crystal structure of aluminum oxide is known to shift from gibbsite or boehmite to $\gamma$, $\sigma$, $\eta$, $\Theta$ and $\alpha$ types depending on the temperature of heat treatment. In the present invention, there can naturally be employed aluminum oxide of any crystal structure or any manufacturing method.

Aluminum-based pigment such as aluminum oxide or alumina hydrate employed in the upper layer of the present invention preferably has a BET specific surface area within a range of 100–160 $m^2/g$, since a BET specific area exceeding 160 $m^2/g$ may deteriorate the ink absorbability depending on the particle size of the pigment, and that less than 100 $m^2/g$ may result in a lowering of color density by light scattering. In the latter case, there is preferably employed an additive such as a cationic agent.

Aluminum-based pigment such as aluminum oxide or alumina hydrate employed in the lower layer of the present invention preferably has a BET specific surface area within a range of 150–300 $m^2/g$, more preferably 150–250 $m^2/g$, since a BET specific surface area exceeding 300 $m^2/g$ may deteriorate the ink absorbability depending on the particle size of the pigment, and that less than 150 $m^2/g$ may elongate the time required for color stabilization by eliminating the color turbidity caused by solvent after printing, though the color density becomes higher.

The average particle diameter of the aluminum-based pigment to be employed in the upper layer of the present invention is preferably within a range of from 150 nm to 1 $\mu$m. An average particle diameter less than 150 nm may lower the ink absorbability while that exceeding 1 $\mu$m may slightly lower the gloss.

In the formation of the ink-receiving layer in the recording medium of the present invention, there may be employed a binder if necessary. Preferred examples of the binder that can be employed in combination with the alumina-based pigment include water-soluble polymers, such as polyvinyl alcohol or modified products thereof, starch or modified products thereof, gelatin or modified products thereof, casein or modified products thereof, gum arabic, cellulose derivatives such as carboxymethyl cellulose, hydroxyethyl cellulose or hydroxypropylmethyl cellulose, conjugate dienic copolymer latex such as SBR latex, NBR latex or methyl methacrylate-butadiene copolymer, functionally modified polymer latex, vinylic copolymer latex such as ethylene-vinyl acetate copolymer, polyvinyl pyrollidone, maleic anhydride or copolymers thereof, acrylate ester copolymers etc. Such binders may be employed singly or as a mixture of plural kindes.

The mixing ratio of alumina-based pigment and binder may be arbitrarily selected within a preferred range of 5:1–15:1 interms of weight ratio. The binder within the above-mentioned range can increase the mechanical strength of the ink-receiving layer and to prevent cracking or powder generation at the formation of the ink-receiving layer, thereby maintaining preferable pore volume.

The coating liquid for forming the ink-receiving layer may further contain, in addition to alumina hydrate and binder, a dispersant, a viscosifier, a pH adjusting agent, a lubricant, a fluidity modifier, a surfactant, an antifoaming agent, a water repellant, a releasing agent, a fluorescent whitening agent, an ultraviolet absorber, an antioxidant etc. if necessary, within a range not affecting the effects of the present invention.

In the recording medium having the ink-receiving layer of the present invention, the ink-receiving layer can be formed on the base material by coating and drying a dispersion containing aforementioned alumina hydrate by a coating appratus on the base material. The coating method is not particularly limited and there can be utilized coating techniques with the ordinary coating apparatus such as a blade coater, an air-knife coater, a roller coater, a curtain coater, a bar coater, a gravure coater, a die coater or a spray coater.

The coating amount of the coating liquid in the formation of the upper layer preferably does not exceed 20 $g/m^2$, calculated in terms of dry solid matter, more preferably within a range of 10–20 $g/m^2$, in order to improve the fixability for the coloring material such as a dye in the recoreding liquid and the smoothness of the ink-receiving layer. A baking process may be applied, if necessary, to the ink-receiving layer after the formation thereof. Even for the coating amount not exceeding 20 $g/m^2$ in terms of dry solid matter, there can be obtained sufficient effect for reducing the period required for color stabilization, but that less than 10 $g/m^2$ may result in a decrease in the ink absorbability.

The coating amount of the coating liquid in the formation of the lower layer preferably does not exceed 25 $g/m^2$, calculated in terms of dry solid matter, more preferably within a range of 10–20 $g/m^2$, in order to improve the fixability for the coloring material such as a dye in the recoreding liquid and the smoothness of the entire ink-receiving layer. The coating amount not exceeding 25 $g/m^2$ in terms of dry solid matter can effectively suppress formation of cracks and defects in the coating process, thereby enabling more efficient formation of the coating layer. Also the coating amount not less than 10 $g/m^2$ in terms of dry solid matter achieves a sufficient effect for reducing the period required for color stabilization.

After the formation of the ink-receiving layer, there is preferably carried out a smoothing process such as a casting process. The casting process may be carried out by a direct method, a gellation method or a rewetting method. In the direct method, the ink-receiving layer, coated on the base material at the formation thereof and still in a wet state, is dried by pressing the surface of the layer to a heated mirror-surface drum. In the gellation method, the ink-receiving layer, coated on the base material at the formation thereof and still in a wet state, is brought into contact with a gellation bath for bringing the layer into a gel state and is dried by pressing the surface of the layer to a heated mirror-surface drum. In the rewetting method, the ink-receiving layer, after the formation thereof, is processed for example with hot water to restore a wet state and is dried by pressing the surface of the layer to a heated mirror-surface drum. These methods can provide strong gloss on the surface of the ink-receiving layer. However, in case of employing a dense base material for obtaining a recording medium capable of showing a texture comparable to that of the silver halide photograph, the rewetting method is preferred as the smoothing process. This is because, in drying the wet ink-receiving layer by pressing to the mirror surface drum, the water evaporation from the rear surface is extremely limited in a dense base material.

In the recording medium of the present invention, the surface gloss at the side of the ink-receiving layer is equal to or higher than 20% when measured at an angle of 20° (20° surface gloss).

In the recording medium of the present invention, a back coat layer may be provided on the rear surface of the base material (opposite to the ink-receiving layer), in order to prevent curling for example at the recording operation. Curling is generated by a difference in the elongation by humidity between the base material and the ink-receiving layer. In order to suppress such curling, the back coat layer preferably generates a change (shrinkage) similar to that in the ink-receiving layer at the surface upon moisture absorption. The back coat layer can be formed for example by a layer containing alumina. Examples of such alumina include alumina hydrate such as boehmite or pseudo boehmite, or alumina oxide such as $\gamma$-alumina or $\Theta$-alumina. However such materials are not restrictive, and there can be employed any material showing a change in such a direction as to cancel the change in the surfacial ink-receiving layer at moisture absorption.

In the formation of the back coat layer, there may be employed a binder if necessary. Preferred examples of the binder that can be employed in combination with the alumina include water-soluble polymers, such as polyvinyl alcohol or modified products thereof, starch or modified products thereof, gelatin or modified products thereof, casein or modified products thereof, gum arabic, cellulose derivatives such as carboxymethyl cellulose, hydroxyethyl cellulose or hydroxypropylmethyl cellulose, conjugate dienic copolymer latex such as SBR latex, NBR latex or methyl methacrylate-butadiene copolymer, functionally modified polymer latex, vinylic copolymer latex such as ethylene-vinyl acetate copolymer, polyvinyl pyrollidone, maleic anhydride or copolymers thereof, acrylate ester copolymers etc. Such binders may be employed singly or as a mixture of plural kindes.

The mixing ratio of alumina and binder can be arbitrarily selected within a range of 5:1–25:1 in terms of weight ratio. The binder within the above-mentioned range can improve the curl preventing ability and the mechanical strength of the back coat layer. Also in the back coat layer there may be added a dispersant, a viscosifier, a pH adjusting agent, a lubricant, a fluidity modifier, a surfactant, an antifoaming agent, a water repellant, a releasing agent, a fluorescent whitening agent, an ultraviolet absorber, an antioxidant etc. if necessary, within a range not affecting the effects of the present invention.

In the recording medium of the present invention having the back coat layer, the back coat layer can be formed on the base material by coating and drying dispersion containing aforementioned alumina by a coating appratus on the base material. The coating method is not particularly limited and there can be utilized coating techniques with the ordinary coating apparatus such as a blade coater, an air-knife coater, a roller coater, a curtain coater, a bar coater, a gravure coater, a die coater or a spray coater. The coating amount of the coating liquid in the formation of the back coat layer is preferably within a range of 5–25 g/m$^2$, calculated in terms of dry solid matter, more preferably an upper limit of 20 g/m$^2$ and a lower limit of 10 g/cm$^2$. A baking process may be applied, if necessary, to the back coat layer after the formation thereof. The back coat layer thus formed provides a secure countermeasure in case where curling may be generated for example in the recording process. Also the alumina-based back coat layer provides satisfactory writeability on the rear surface with various writing utencils such as a pencil, a fountain pen, a ball-point pen or a felt pen.

The ink-jet recording method can be employed without limitation, such as a method utilizing a piezoelectric element or a method utilizing a heat generating element. Also the recording liquid to be employed for image formation can be an ink-jet ink containing a coloring material such as a dye in an aqueous solvent.

In the following the present invention will be explained in further detail by examples and reference examples. In the present invention, the BET specific surface area was measured with the nitrogen absorption method (utilizing Autosorb manufactured by Quantachrome Inc.).

EXAMPLE 1

As alumina hydrate A, Disperal HP13 (trade name, supplied by Condea Inc.) with a BET specific surface area of 170 m$^2$/g was mixed in purified water with acetic acid as the dispersant to obtain dispersion (colloidal sol) of a solid content of 20 wt. %.

Also alumina hydrate B was obtained in the following manner. At first Disperal HP13 (trade name, supplied by Condea Inc.) was mixed with purified water to obtain dispersion of a solid content of 5 wt. %. Then hydrochroric acid was added to pH 4 and the dispersion was stirred for a while. Thereafter the dispersion was heated under stirring to 95° C. and was maintained for 2 hours at this temperature. Then sodium hydroxide was added to pH 10 and the dispersion was maintained under stirring for 8 hours. After 8 hours, the temperature of the dispersion was returned to the room temperature, and pH was adjusted to 7–8. Then a desalting process was executed, and acetic acid was added to effect a peptization process thereby obtaining a colloidal sol. The colloidal sol was concentrated to obtain a solution of a solid content of 17 wt. %. The alumina hydrate obtained by drying the colloidal sol had a pseudo boehmite structure under X-ray diffraction analysis and had a BET specific surface area of 138 m$^2$/g.

Also polyvinyl alcohol PVA 117 (trade name; supplied by Kurarey Co.) was dissolved in purified water to obtain solution of a concentration of 9 wt. %. The colloidal sol of the aforementioned alumina hydrate A and this polyvinyl alcohol solution were mixed and stirred in such a manner that the solid content of alumina hydrate and the solid content of polyvinyl alcohol have a weight ratio of 10:1 to obtain dispersion 1.

Also the colloidal sol of the aforementioned alumina hydrate B and the aforementioned polyvinyl alcohol solution were mixed and stirred in such a manner that the solid content of alumina hydrate and the solid content of polyvinyl alcohol have a weight ratio of 10:1 to obtain dispersion 2.

The dispersion 1 was applied by die coating with a dry coating amount of about 15 g/m$^2$ on a barium sulfate layer of a base material, having a basis weight of 150 g/m$^2$, a Stockigt sizing degree of 200 seconds, a Bekk smoothness of 420 seconds and a whiteness of 89% and having a barium sulfate layer, thereby forming a lower layer of the ink-receiving layer. Then the dispersion 2 was applied in a similar manner with a dry coating amount of about 17 g/m$^2$ as an upper layer of the ink-receiving layer on the coated layer of the dispersion 1, thereby providing a recording medium 1.

The surface of the ink-receiving layer of the recording medium 1 was subjected to a rewetting casting process employing a rewetting cast coater and utilizing hot water (80° C.) to obtain a recording medium 2.

EXAMPLE 2

Aluminum octoxide was synthesized by a method disclosed in the U.S. Pat. Nos. 4,242,271 and 4,202,870 and was then hydrolyzed to obtain alumina slurry. Then a post process such as drying was executed to obtain powdered pseudo boehmite, which was baked for 2 hours in an oven of 500° C. to obtain aluminum oxide particles having a γ-crystal structure (hereinafter called γ-alumina) The γ-alumina was dispersed in purified water with a concentration of 20 wt. % utilizing acetic acid as a dispersant. The obtained dispersion was then processed for 40 hours in a ball mill, and coarse particles were eliminated by centrifuging to obtain processed γ-alumina. The above-mentioned particles after drying had a BET specific surface area of 130 m$^2$/g. The dispersion of the aforementioned processed alumina and the polyvinyl alcohol solution prepared in the example 1 were mixed and stirred in such a manner that the solid content of aluminum oxide and that of polyvinyl alcohol had a weight ratio of 7:1 to obtain dispersion 3.

The dispersion 3 was applied by die coating with a dry coating weight of about 17 g/m$^2$ on the lower layer of the ink-receiving layer prepared in the example 1, thereby providing a recording medium 3.

The recording medium 3 was further subjected to rewetting casting process as in the example 1 to obtain a recording medium 4.

Comparative Example 1

The dispersion 2 employed in the example 1 was applied by die coating with a dry coating amount of about 30 g/m$^2$ on a barium sulfate layer of a base material, having a basis weight of 150 g/m$^2$, a Stockigt sizing degree of 200 seconds, a Bekk smoothness of 420 seconds and a whiteness of 89% and having a barium sulfate layer, thereby forming a recording medium 5. The recording medium 5 was subjected to a rewetting casting process as in the example 1 to obtain a recording medium 6.

Comparative Example 2

The process of the example 1 was repeated except that the dispersion 1 employed in the example 1 was replaced by aluminum oxide of a BET specific surface area of 100 m$^2$/g in forming the lower layer of the ink-receiving layer, thereby obtaining a recording medium 7.

Test Example 1

On the recording media obtained in the foregoing examples and reference examples, the 20° gloss of the ink-receiving layer side was measured with a digital variable-angle gloss meter (manufactured by Suga Shikenki K. K.) according to JIS-Z8142. The obtained results are shown in Table. 1. The glossy surface of the ink-receiving layer of each of these recording media was printed with an ink-jet printer (BJF-850 manufactured by Canon Co.) and the change in time of the optical density was measured. Table. 1 shows the time required for reaching 95% of the finally stabilized color density. Also in printing an image according to photographic information on the glossy surface of the ink-receiving layer of the recording medium by an ink-jet printer (BJF-850 manufactured by Canon Co.), there could be formed an image of texture and image quality comparable to those of the silver halide photograph.

TABLE 1

| | Rec. Medium | 20° gloss | Time for color stabilization*1) |
|---|---|---|---|
| Example 1 | 2 | 30.5% | 3 minutes |
| Example 2 | 4 | 28.5% | 4 minutes |
| Comp. Ex.1 | 6 | 26.0% | 60 minutes |
| Comp. Ex.2 | 7 | 28.0% | 80 minutes |

*1)time required for reaching 95% of stabilized color density

On the image forming surface of the ink-receiving layer of the recording medium of the present invention, there can be given high gloss not less than 20% in 20° gloss, and image formation for example by an ink-jet recording method can provide a print comparable in texture and image quality to the silver halide photograph. Also the ink-receiving layer of the recording medium of the present invention retains porous structure despite of highly glossy surface, and is less prone to generate surface blocking or surface stain such as fingerprints, and such recording medium can provide a print excellent in stability in storage.

Also there can be provided a recording medium of a low manufacturing cost since aluminum-based pigment is used as the principal component.

Furthermore, the ink-receiving layer is formed with a two-layered structure consisting of an upper layer and a lower layer, and the specific surface area of the aluminum-based pigement contained in the lower layer is made larger than that in the upper layer, whereby achieved are an improvement in the resistance of the printed color to light and ozone and a reduction in the time required for color stabilization.

What is claimed is:

1. An ink-jet recording medium comprising a base material and an ink-receiving layer provided thereon, wherein said ink-receiving layer comprises an upper layer containing aluminum oxide or alumina hydrate, and a lower layer containing aluminum oxide or alumina hydrate having a BET specific surface area larger than that of the aluminum oxide or alumina hydrate contained in said upper layer.

2. The ink-jet recording medium according to claim 1, wherein the BET specific surface area of the aluminum oxide or alumina hydrate contained in the upper layer is within a range of 100–160 m$^2$/g, and the BET specific surface area of the aluminum oxide or alumina hydrate contained in the lower layer is within a range of 150–300 m$^2$/g.

3. The ink-jet recording medium according to claim 2, wherein the BET specific surface area of the aluminum oxide or alumina hydrate contained in said lower layer is within a range of 150–250 m$^2$/g.

4. The ink-jet recording medium according to claim 1 or 2, wherein the aluminum oxide or alumina hydrate contained in the upper layer has an average particle diameter of not less than 150 nm and not exceeding 1 $\mu$m.

5. The ink-jet recording medium according to any one of claims 1 to 3, wherein said base material is provided with a surface layer containing barium sulfate, and said ink-receiving layer is provided on said surface layer.

6. An image forming method which comprises forming an image by applying a recording liquid in response to recording information on the ink-receiving layer of the recording medium according to claim 1 or 2.

7. The image forming method according to claim 6, wherein the application of said recording liquid is conducted by an ink-jet recording system.

8. The ink jet recording medium according to claim 4, wherein said base material is provided with a surface layer containing barium sulfate, and said ink-receiving layer is provided on said surface layer.

9. An ink-jet recording medium comprising a base material and an ink-receiving layer provided thereon, wherein said ink-receiving layer comprises an upper layer containing aluminum oxide or alumina hydrate, and a lower layer containing alumina oxide or alumina hydrate having a BET specific surface area larger than that of the alumina oxide or alumina hydrate contained in said upper layer, and the amount of the solid matter of the upper layer is 10 g/m$^2$ or more.

10. The ink-jet recording medium according to claim 9, wherein the amount of the solid matter of the lower layer is within a range of 10–25 g/m$^2$, and the amount of the solid matter of the upper layer is within a range of 10–20 g/m$^2$.

11. The ink-jet recording medium according to claim 9, wherein the BET specific surface area of the aluminum oxide or alumina hydrate contained in the upper layer is within a range of 100–160 m$^2$/g, and the BET specific surface area of the aluminum oxide or alumina hydrate contained in the lower layer is within a range of 150–300 m$^2$/g.

12. The ink-jet recording medium according to claim 11, wherein the BET specific surface area of the aluminum oxide or alumina hydrate contained in said lower layer is within a range of 150–250 $m^2/g$.

13. The ink-jet recording medium according to claim 9, wherein the aluminum oxide or alumina hydrate contained in the upper layer has an average particle diameter of not less than 150 nm and not exceeding 1 $\mu$m.

14. The ink-jet recording medium according to claim 9, wherein said base material is provided with a surface layer containing barium sulfate, and said ink-receiving layer is provided on said surface layer.

15. An image forming method which comprises forming an image by applying a recording liquid in response to recording information on the ink-receiving layer of the recording medium according to claim 9.

16. The image forming method according to claim 15, wherein the application of said recording liquid is conducted by an ink-jet recording system.

17. The ink-jet recording medium according to claim 13, wherein said base material is provided with a surface layer containing barium sulfate, and said ink-receiving layer is provided on said surface layer.

* * * * *

UNITED STATES PATENT AND TRADEMARK OFFICE

CERTIFICATE OF CORRECTION

PATENT NO. : 6,696,118 B2
DATED : February 24, 2004
INVENTOR(S) : Masanobu Asaoka et al.

It is certified that error appears in the above-identified patent and that said Letters Patent is hereby corrected as shown below:

Column 1,
Line 19, “paper it” should read -- paper. It --.

Column 2,
Line 17, “to form” should read -- formation of --.
Line 32 and 35, “to employ” should read -- employment of --.

Column 5,
Line 31, “In” should read -- in --.

Column 6,
Line 27, “becomes” should read -- be --.
Line 35, “(collect czech Chem Commun,” should read -- (Collect. Czech. Chem. Commun., --.

Column 7,
Line 42, “kindes.” should read -- kinds. --.
Line 45, “interms” should read -- in terms --.

Column 8,
Lines 4 and 16, “recoreding” should read -- recording --.

Column 9,
Line 1, “surfacial” should read -- surface --.
Line 18, “kindes.” should read -- kinds. --.
Line 33, “appratus” should read -- apparatus --.

Column 10,
Line 4, “hydochroric” should read -- hydrochloric --.

Column 11,
Line 61, “of” should read -- a --.

UNITED STATES PATENT AND TRADEMARK OFFICE

CERTIFICATE OF CORRECTION

PATENT NO. : 6,696,118 B2
DATED : February 24, 2004
INVENTOR(S) : Masanobu Asaoka et al.

It is certified that error appears in the above-identified patent and that said Letters Patent is hereby corrected as shown below:

Column 12,
Line 4, “pigement” should read -- pigment --.
Lines 52 and 54 , “alumina oxide” should read -- aluminum oxide --.

Signed and Sealed this

Sixth Day of July, 2004

JON W. DUDAS
*Acting Director of the United States Patent and Trademark Office*